US011348553B2

(12) United States Patent
Su et al.

(10) Patent No.: US 11,348,553 B2
(45) Date of Patent: May 31, 2022

(54) COLOR GAMUT MAPPING IN THE CIE 1931 COLOR SPACE

(71) Applicant: Samsung Electronics Co., Ltd., Suwon-si (KR)

(72) Inventors: Chang Su, Foothill Ranch, CA (US); Pradeep Nagesh, Irvine, CA (US); Yeong-Taeg Kim, Irvine, CA (US); Li Tao, Irvine, CA (US)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/786,355

(22) Filed: Feb. 10, 2020

(65) Prior Publication Data

US 2020/0258473 A1 Aug. 13, 2020

Related U.S. Application Data

(60) Provisional application No. 62/804,089, filed on Feb. 11, 2019.

(51) Int. Cl.
*G09G 5/02* (2006.01)

(52) U.S. Cl.
CPC ..... *G09G 5/02* (2013.01); *G09G 2320/0666* (2013.01); *G09G 2340/06* (2013.01)

(58) Field of Classification Search
CPC ..... G09G 5/02; G09G 2320/0666; G09G 2340/06
See application file for complete search history.

(56) References Cited

U.S. PATENT DOCUMENTS

| | | | |
|---|---|---|---|
| 5,299,291 | A | 3/1994 | Ruetz |
| 5,450,216 | A | 9/1995 | Kasson |
| 5,574,666 | A | 11/1996 | Ruetz et al. |

(Continued)

FOREIGN PATENT DOCUMENTS

| | | | |
|---|---|---|---|
| CN | 108259701 | A | 7/2018 |
| JP | 5849549 | B2 | 1/2016 |
| WO | 2011143117 | A2 | 11/2011 |

OTHER PUBLICATIONS

Bronner, T-F. et al. "Evaluation of Color Mapping Algorithms in Different Color Spaces," Applications of Digital Image Processing XXXIX, 2016, pp. 1-11, vol. 9971, International Society for Optics and Photonics, United States.

(Continued)

*Primary Examiner* — William A Beutel
(74) *Attorney, Agent, or Firm* — Sherman IP LLP; Kenneth L. Sherman; Hemavathy Perumal

(57) ABSTRACT

One embodiment provides a method comprising determining a target color gamut of a display device, an inner zone of the target color gamut, and an outer zone of the target color gamut. The method further comprises dynamically determining, based on the inner zone and the outer zone, a path along which an input color in a source color gamut of an input content moves. The input color is outside the inner zone. The method further comprises mapping the input color from the source color gamut to an output color in the outer zone based on the path. The input color is rendered as the output color during presentation of the input content on the display device.

20 Claims, 9 Drawing Sheets
(3 of 9 Drawing Sheet(s) Filed in Color)

(56) References Cited

U.S. PATENT DOCUMENTS

| | | | | |
|---|---|---|---|---|
| 7,356,181 | B2 | 4/2008 | Haikin | |
| 7,573,610 | B2 | 8/2009 | Um et al. | |
| 7,583,406 | B2 | 9/2009 | Spaulding et al. | |
| 8,026,953 | B2 | 9/2011 | Lammers et al. | |
| 8,049,765 | B2 | 11/2011 | Ahn et al. | |
| 8,243,090 | B2 | 8/2012 | Scheibe | |
| 8,411,022 | B2 | 4/2013 | Brown Elliott et al. | |
| 8,520,938 | B2 | 8/2013 | Rozzi et al. | |
| 8,890,884 | B2 | 11/2014 | Zhang | |
| 8,937,746 | B2 | 1/2015 | Maltz et al. | |
| 9,179,042 | B2 | 11/2015 | Atkins | |
| 9,190,014 | B2 | 11/2015 | Messmer et al. | |
| 9,432,554 | B2 | 8/2016 | Doser et al. | |
| 9,466,260 | B2 | 10/2016 | Higgins | |
| 9,472,162 | B2 | 10/2016 | Stauder et al. | |
| 9,489,919 | B2 | 11/2016 | Wang et al. | |
| 9,552,793 | B2 | 1/2017 | Chun et al. | |
| 9,583,035 | B2 | 2/2017 | Buckley et al. | |
| 9,600,906 | B2 | 3/2017 | Sakai | |
| 9,646,392 | B2 | 5/2017 | Li et al. | |
| 9,661,187 | B1 | 5/2017 | Chen | |
| 10,129,558 | B2 | 11/2018 | Ramasubramonian et al. | |
| 2005/0276474 | A1 | 12/2005 | Um et al. | |
| 2007/0223018 | A1* | 9/2007 | Lammers | H04N 1/6058 358/1.9 |
| 2009/0009539 | A1* | 1/2009 | Ahn | G09G 5/02 345/690 |
| 2009/0040564 | A1 | 2/2009 | Granger | |
| 2010/0225238 | A1* | 9/2010 | Medin | H04N 9/3155 315/210 |
| 2013/0176326 | A1 | 7/2013 | Safaee-Rad et al. | |
| 2015/0077431 | A1 | 3/2015 | Tsukada et al. | |
| 2015/0350492 | A1 | 12/2015 | Kurtz et al. | |
| 2016/0309154 | A1 | 10/2016 | Rusanovskyy et al. | |
| 2017/0048561 | A1 | 2/2017 | Oh et al. | |
| 2017/0163851 | A1 | 6/2017 | Yamada | |
| 2017/0272780 | A1 | 9/2017 | Pan et al. | |
| 2017/0359491 | A1 | 12/2017 | Stauder et al. | |
| 2018/0139360 | A1 | 5/2018 | Francois et al. | |
| 2018/0300862 | A1 | 10/2018 | Keating | |
| 2018/0352257 | A1 | 12/2018 | Leleannec et al. | |
| 2019/0158894 | A1* | 5/2019 | Lee | H04N 19/70 |

OTHER PUBLICATIONS

Azimi, M., et al., "A Color Gamut Mapping Scheme for Backward Compatible UHD Video Distribution," IEEE ICC Communications Software, Services, and Multimedia Applications Symposium, 2017, pp. 2-5, IEEE, United States.

Sikudova, E., et al., "A Gamut-Mapping Framework for Color-Accurate Reproduction of HDR Images," Jul.-Aug. 2016, pp. 78-90, IEEE Computer Society, United States.

Morovic, J., et al., "Calculating Medium and Image Gamut Boundaries for Gamut Mapping," Dec. 2000, pp. 394-401, Colour & Imaging Institute, v. 25, No. 6, United Kingdom.

Sharma, G., et al., "The CIEDE2000 Color-Difference Formula: Implementation Notes, Supplementary Test Data, and Mathematical Observations," Feb. 2005, pp. 21-30, vol. 30, No. 1, Wiley Periodicals, Inc., United States.

Froehlich, J., et al., "Creating Cinematic wide gamut HDR-video for the evaluation of tone mapping operators and HDR-Displays," Digital Photography X, 2014, pp. 1-10, International Society for Optics and Photonics, United States.

Yang, C.C. et al., "Gamut Clipping in Color Image Processing," IEEE, 2000, pp. 824-827, United States.

Azimi, M. et al., "A Hybrid Approach for Efficient Color Gamut Mapping," pp. 1-2, 2017 IEEE International Conference on Consumer Electronics (ICCE), United States.

SMPTE RP 177-1993, "Derivation of Basic Television Color Equations," Society of Motion Pictures & Television Engineers, Inc., 1993, pp. 1-4, White Plains, NY.

Masaoka, K., et al., "Algorithm Design for Gamut Mapping From UHDTV to HDTV," Journal of Display Technology, Jul. 2016, pp. 760-769, vol. 12, No. 7, IEEE, United States.

Yuan, J. et al., "Development and Evaluation of a Hybrid Point-wise Gamut Mapping Framework," Colour and Visual Computing Symposium (CVCS), 2015, pp. 1-4, IEEE, United States.

Fairchild, M.D., "Color Appearance Models," 2005, pp. 1-409, Second Edition, John Wiley & Sons, Ltd., United States.

Borg, L., "SMPTE ST 2094 and Dynamic Metadata," SMPTE Standards Webcast Series, 2017, pp. 1-15, Society of Motion Pictures & Television Engineers, Inc.

U.S. Non-Final Office Action for U.S. Appl. No. 16/216,171 dated Aug. 7, 2019.

U.S. Notice of Allowance for U.S. Appl. No. 16/216,171 dated Dec. 10, 2019.

International Search Report and Written Opinion dated May 18, 2020 for International Application PCT/KR2020/001873 from Korean Intellectual Property Office, pp. 1-7, Republic of Korea.

* cited by examiner

COLOR GAMUT MAPPING IN THE CIE 1931 COLOR SPACE

CROSS-REFERENCE TO RELATED APPLICATIONS

The present application claims priority to U.S. Provisional Patent Application No. 62/804,089, filed on Feb. 11, 2019, hereby incorporated by reference in its entirety.

TECHNICAL FIELD

One or more embodiments generally relate to color gamut mapping, in particular, a method and system for color gamut mapping in the CIE 1931 color space.

BACKGROUND

Color gamut mapping (CGM), or color gamut transferring (CGT), involves mapping between different color gamuts.

The International Commission on Illumination (CIE) creates international standards related to light and color. In 1931, the CIE created the perceptually non-uniform CIE 1931 XYZ color space, which is an international standard that defines quantitative links between distributions of wavelengths in the electromagnetic visible spectrum and physiologically perceived colors in human color vision. The CIE 1931 xyY color space is derived from the CIE 1931 XYZ color space. For expository purposes, the terms "CIE 1931 color space" and "CIE 1931 xyY color space" are used interchangeably in this specification.

SUMMARY

One embodiment provides a method comprising determining a target color gamut of a display device, an inner zone of the target color gamut, and an outer zone of the target color gamut. The method further comprises dynamically determining, based on the inner zone and the outer zone, a path along which an input color in a source color gamut of an input content moves. The input color is outside the inner zone. The method further comprises mapping the input color from the source color gamut to an output color in the outer zone based on the path. The input color is rendered as the output color during presentation of the input content on the display device.

Another embodiment provides a system comprising at least one processor and a non-transitory processor-readable memory device storing instructions that when executed by the at least one processor causes the at least one processor to perform operations. The operations include determining a target color gamut of a display device, an inner zone of the target color gamut, and an outer zone of the target color gamut. The operations further include dynamically determining, based on the inner zone and the outer zone, a path along which an input color in a source color gamut of an input content moves. The input color is outside the inner zone. The operations further include mapping the input color from the source color gamut to an output color in the outer zone based on the path. The input color is rendered as the output color during presentation of the input content on the display device.

One embodiment provides a non-transitory processor-readable medium that includes a program that when executed by a processor performs a method. The method comprises determining a target color gamut of a display device, an inner zone of the target color gamut, and an outer zone of the target color gamut. The method further comprises dynamically determining, based on the inner zone and the outer zone, a path along which an input color in a source color gamut of an input content moves. The input color is outside the inner zone. The method further comprises mapping the input color from the source color gamut to an output color in the outer zone based on the path. The input color is rendered as the output color during presentation of the input content on the display device.

These and other aspects and advantages of one or more embodiments will become apparent from the following detailed description, which, when taken in conjunction with the drawings, illustrate by way of example the principles of the one or more embodiments.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a fuller understanding of the nature and advantages of the embodiments, as well as a preferred mode of use, reference should be made to the following detailed description read in conjunction with the accompanying drawings, in which.

DETAILED DESCRIPTION

Figure 1:
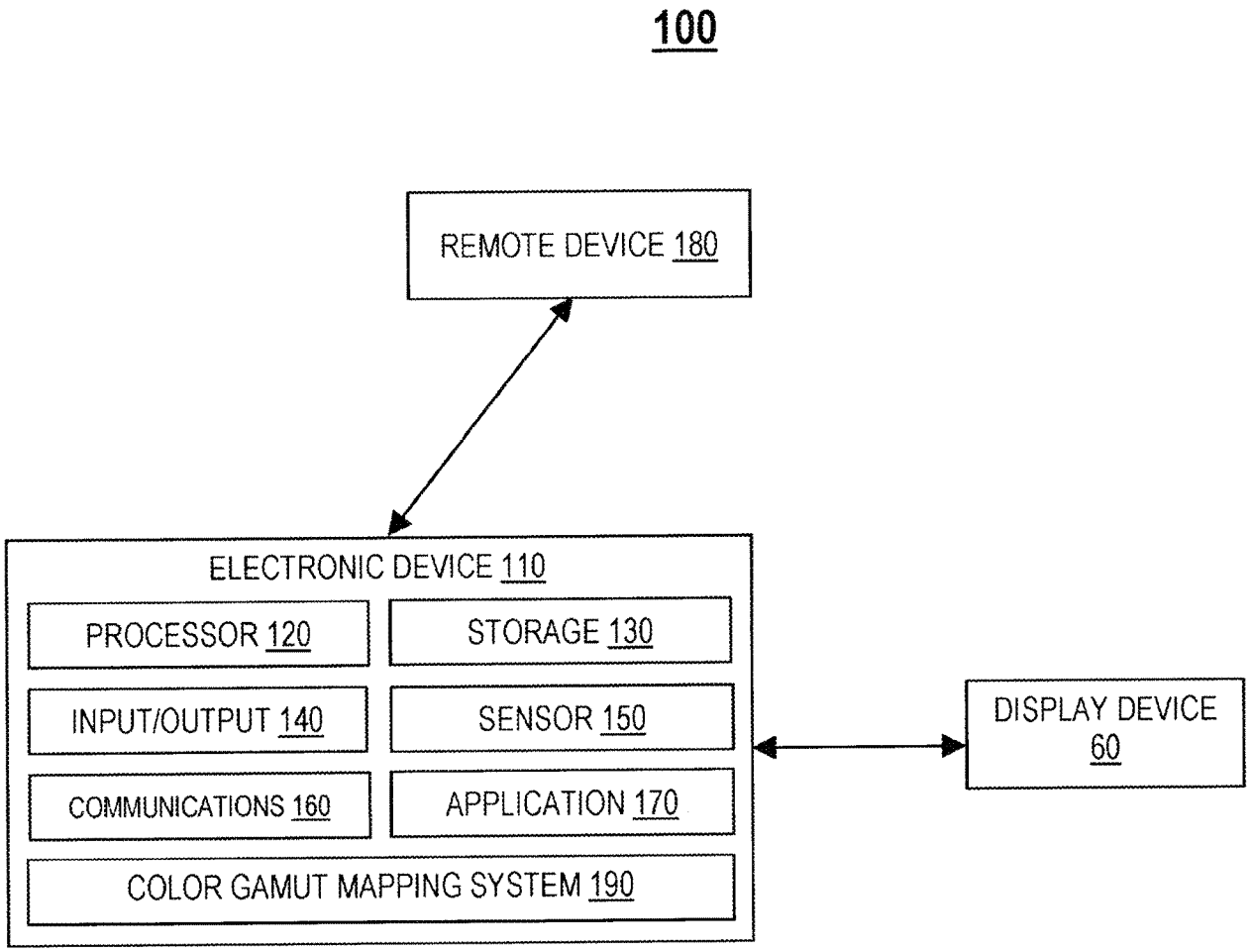
FIG. 1 illustrates an example computing architecture for implementing color gamut mapping (CGM) of HDR/WCG content for presentation on a display device, in one or more embodiments.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments generally relate to color gamut mapping, in particular, a method and system for color gamut mapping in the CIE 1931 color space. One embodiment provides a method comprising determining a target color gamut of a display device, an inner zone of the target color gamut, and an outer zone of the target color gamut. The method further comprises dynamically determining, based on the inner zone and the outer zone, a path along which an input color in a source color gamut of an input content moves. The input color is outside the inner zone. The method further comprises mapping the input color from the source color gamut to an output color in the outer zone based on the path. The input color is rendered as the output color during presentation of the input content on the display device.

Another embodiment provides a system comprising at least one processor and a non-transitory processor-readable memory device storing instructions that when executed by the at least one processor causes the at least one processor to perform operations. The operations include determining a target color gamut of a display device, an inner zone of the target color gamut, and an outer zone of the target color gamut. The operations further include dynamically determining, based on the inner zone and the outer zone, a path along which an input color in a source color gamut of an input content moves. The input color is outside the inner zone. The operations further include mapping the input color from the source color gamut to an output color in the outer zone based on the path. The input color is rendered as the output color during presentation of the input content on the display device.

One embodiment provides a non-transitory processor-readable medium that includes a program that when executed by a processor performs a method. The method comprises determining a target color gamut of a display device, an inner zone of the target color gamut, and an outer zone of the target color gamut. The method further comprises dynamically determining, based on the inner zone and the outer zone, a path along which an input color in a source color gamut of an input content moves. The input color is outside the inner zone. The method further comprises mapping the input color from the source color gamut to an output color in the outer zone based on the path. The input color is rendered as the output color during presentation of the input content on the display device.

As high-dynamic range (HDR) content and wide-color gamut (WCG) content becomes more popular in the broadcasting industry, color gamut matching issues between HDR/WCG content and drivers in user-end displays (e.g., a HDR display, a SDR display, etc.) becomes a bottle-neck problem and greatly limits popularity of HDR/WCG content.

Let $\Omega_S$ generally denote a color gamut of HDR/WCG content ("source gamut"), and let $\Omega_T$ generally denote a color gamut of a user-end display device ("target gamut"). If a source gamut $\Omega_S$ of HDR/WCG content is larger than a target gamut $\Omega_T$ of a user-end display device, not all colors in the source gamut $\Omega_S$ can be correctly rendered on the user-end display device, such that hue distortions and high visual impacts may occur.

The BT.2020 and the BT.2100 are standards ratified by the International Telecommunication Union (ITU). The BT.2020 defines various aspects of ultra-high-definition television (UHDTV) with standard dynamic range (SDR) and WCG such as color gamut, frame-rate, color bit-depth, etc. The BT.2100 expands on several aspects of the BT.2020 and defines various aspects of HDR video such as display resolution (high-definition television (HDTV) and UHDTV), frame rate, chroma subsampling, bit depth, color space, optical transfer function, etc. The BT.2020/BT.2100 is the widest color gamut in the HDR broadcasting industry. In recent years, content creators tend to master HDR/WCG content directly on the BT.2020/BT.2100 color gamut which covers 75.8% of the CIE 1931 color space, making color gamut mismatching issues more serious.

In commercial applications, CGM techniques are used to render HDR/WCG image content on a display device with limited color gamut. Conventional techniques for CGM can be classified into two categories. One category of conventional CGM techniques is based on a color appearance model (CAM) and is carried out in uniform color space (e.g., CIELAB, CIELCH, IPT, etc.). CAM-based CGM techniques typically carry out CGM in luminance-chroma (L-C) planes (i.e., brightness-saturation planes) by fixing hue, such that converted colors maintain perceptual hues, thereby avoiding introducing high visual impacts. Specifically, a CAM-based CGM technique represents source colors in a source gamut $\Omega_S$ with a perceptually uniform CAM first, then moves an out-of-gamut color (OOGC) in a L-C plane (i.e., brightness-saturation plane), such that colors in resulting output maintain perceptual hues and keep color continuity along a color gamut boundary (CGB) in the L-C plane. CAM-based CGM techniques need to define color moving constraints (CMCs) from a set of perceptually robust reference constant hue loci that are defined based on rigorous measurements of human subjects' visual responses to color, wherein OOGCs are moved along the CMCs. As a CGB is non-linear in perceptually uniform color space, a large amount of descriptors for the CGB is necessary to achieve accurate colors in resulting output. Therefore, CAM-based CGM techniques require relatively high system resources, thereby increasing system costs. For example, one conventional CAM-based CGM technique requires a 129×129×129 lookup table (LUT) comprising over 2 million CGB descriptors. Additionally, as CGB is non-linear in uniform color space, CAM-based CGM techniques involve complex non-linear computations (e.g., high-order exponential or trigonometric computations) to determine color movement of OOGCs, further increasing system costs. As CAM-based CGM techniques are expensive in hardware implementations, CAM-based CGM techniques are seldom used in common commercial applications/products (e.g., UHDTV).

Another category of conventional CGM techniques is based on a color space conversion (CSC) model and is carried out in the perceptually non-uniform CIE 1931 color space. Specifically, CSC model-based CGM techniques involve directly converting source colors in a source gamut $\Omega_S$ to corresponding colors in a target gamut $\Omega_T$ that is smaller than the source gamut $\Omega_S$ based on a CSC matrix, followed by clipping OOGCs to boundaries of the target gamut $\Omega_T$ (i.e., color clipping or gamut clipping). As CSC model-based CGM techniques are carried out in non-uniform color space, there is no need to determine uniform color space representations, thereby making CSC model-based CGM techniques cheaper than CAM-based CGM techniques. Further, as a CGB is linear in non-uniform color space, the CGB can be represented by few descriptors. CSC model-based CGM techniques do not require complex non-linear computations to determine color movement of OOGCs (i.e., CSC model-based CGM techniques only utilize linear computations), thereby reducing system costs. However, color clipping may result in small color offsets that lead to perceptible hue distortions and high visual impacts. For example, as OOGCs are always clipped to the boundaries of the target gamut $\Omega_T$, abundant variations in OOGCs are reduced to very few colors or even a single color, resulting in a discontinuity of colors and naturalness in resulting output. The discontinuity of colors may lead to visible banding or spot artifacts in the resulting output, and may generate significant high visual impacts in the output. Therefore, CSC model-based CGM techniques perform poorly in practice compared to CAM-based CGM techniques.

With rapidly developing HDR broadcasting markets, an effective and economic CGM technique is advantageous in today's markets. Embodiments of the disclosed technology provide an effective (e.g., efficient) and low-cost CGM technique that maps colors in a bigger source gamut $\Omega_S$ to corresponding colors in a smaller target gamut $\Omega_T$ in the CIE 1931 space without introducing perceivable artifacts. In at least some cases, embodiment of the disclosed technology do not need to define complex CMCs. In some cases, embodiments of the disclosed technology adaptively determine a color moving path (CMP) of any OOGC in real-time without utilizing reference data (i.e., CMCs), and map the OOGC to a corresponding target color in the target gamut $\Omega_T$ based on the CMP.

Embodiments of the disclosed technology do not adopt the computationally expensive CAMs. Instead, because of linear properties of CGB descriptors in the non-uniform CIE-1931 color space, embodiments of the disclosed technology render artifact-free output with visually smooth and natural colors using linear computations, thereby decreasing costs of hardware implementations. Embodiments of the disclosed technology require few system resources and can be implemented in hardware at low costs. Therefore, embodiments of the disclosed technology are more economic and hardware friendly than the above-described conventional techniques.

FIG. 1 illustrates an example computing architecture 100 for implementing color gamut mapping of HDR/WCG content for presentation on a display device 60, in one or more embodiments. The computing architecture 100 comprises an electronic device 110 including resources, such as one or more processor units 120 and one or more storage units 130. One or more applications may execute/operate on the electronic device 110 utilizing the resources of the electronic device 110.

In one embodiment, the one or more applications on the electronic device 110 include a color gamut mapping system 190 configured to implement color gamut mapping of HDR/WCG content for presentation on a display device 60 integrated in or coupled to the electronic device 110. As described in detail later herein, the color gamut mapping system 190 is configured to: (1) receive input content (e.g., HDR/WCG content) for presentation on the display device 60, (2) convert (i.e., map) colors in a source color gamut of the input content to colors in a target color gamut of the display device 60, and (3) generate output content including the converted colors, wherein the output content is rendered on the display device 60 during the presentation.

Examples of an electronic device 110 include, but are not limited to, a television (e.g., a smart television), a mobile electronic device (e.g., a tablet, a smart phone, a laptop, etc.), a wearable device (e.g., a smart watch, a smart band, a head-mounted display, smart glasses, etc.), a set-top box, an Internet of things (IoT) device, etc.

In one embodiment, the electronic device 110 comprises one or more sensor units 150 integrated in or coupled to the electronic device 110, such as a camera, a microphone, a GPS, a motion sensor, etc.

In one embodiment, the electronic device 110 comprises one or more I/O units 140 integrated in or coupled to the electronic device 110. In one embodiment, the one or more I/O units 140 include, but are not limited to, a physical user interface (PUI) and/or a GUI, such as a keyboard, a keypad, a touch interface, a touch screen, a knob, a button, a display screen, etc. In one embodiment, a user can utilize at least one I/O unit 140 to configure one or more user preferences, configure one or more parameters, provide input, etc.

In one embodiment, the one or more applications on the electronic device 110 may further include one or more software mobile applications 170 loaded onto or downloaded to the electronic device 110, such as a camera application, a social media application, a video streaming application, etc. A software mobile application 170 on the electronic device 110 may exchange data with the system 190.

In one embodiment, the electronic device 110 comprises a communications unit 160 configured to exchange data with one or more remote devices 180 (e.g., receiving a video stream from a remote device 180) and/or the display device 60 (e.g., receiving display characteristics of the display device 60 including the peak luminance level $D_{nit}$) over a communications network/connection (e.g., a wireless connection such as a Wi-Fi connection or a cellular data connection, a wired connection, or a combination of the two). The communications unit 160 may comprise any suitable communications circuitry operative to connect to a communications network and to exchange communications operations and media between the electronic device 110 and other devices connected to the same communications network. The communications unit 160 may be operative to interface with a communications network using any suitable communications protocol such as, for example, Wi-Fi (e.g., an IEEE 802.11 protocol), Bluetooth®, high frequency systems (e.g., 900 MHz, 2.4 GHz, and 5.6 GHz communication systems), infrared, GSM, GSM plus EDGE, CDMA, quadband, and other cellular protocols, VOIP, TCP-IP, or any other suitable protocol.

For example, a remote device 180 may comprise a remote server (e.g., a computer, device, or program that manages network resources, etc.) providing an online platform for hosting one or more online services (e.g., a video streaming service, etc.) and/or distributing one or more software mobile applications 170. As another example, the system 190 may be loaded onto or downloaded to the electronic device 110 from a remote device 180 that maintains and distributes updates for the system 190. As yet another example, a remote device 180 may comprise a cloud computing environment providing shared pools of configurable computing system resources and higher-level services.

Figure 2:
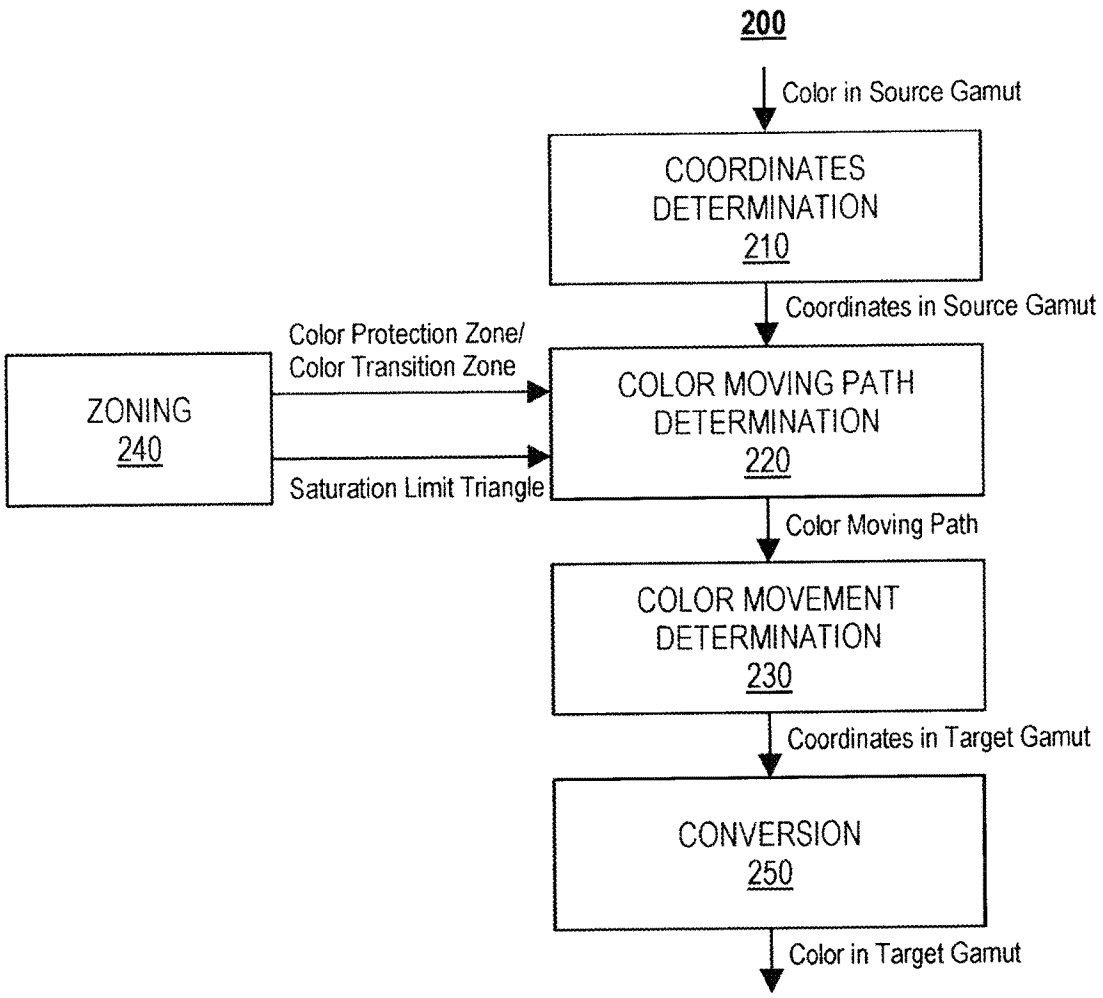
FIG. 2 illustrates an example color gamut mapping system for implementing color gamut mapping of HDR/WCG content for presentation on a display device, in one or more embodiments.

FIG. 2 illustrates an example color gamut mapping system 200 for implementing color gamut mapping of HDR/WCG content for presentation on a display device 60, in one or more embodiments. In one embodiment, the color gamut mapping system 190 in FIG. 1 is implemented as the color gamut mapping system 200. In one embodiment, the system 200 comprises a color coordinates determination unit 210 configured to: (1) receive, as input, content (i.e., HDR content or WCG content) for presentation on a display device 60, and (2) covert colors in a source gamut $\Omega_S$ of the content to color coordinates in the source gamut $\Omega_S$.

In one embodiment, the system 200 comprises a zoning unit 240 configured to divide (i.e., partition) a target gamut $\Omega_T$ of a display device 60 into the following two zones: (1) a color protection (CP) zone representing an inner zone of the target gamut $\Omega_T$, and (2) a color transition (CT) zone representing an outer zone of the target gamut $\Omega Q_T$.

Let $\Omega_P$ generally denote a color gamut of a CP zone. Let $\Omega_Z$ generally denote a color gamut of a CT zone.

In one embodiment, a target gamut $\Omega_T$ is represented in accordance with equation (1) provided below:

$$\Omega_T=\Omega_P+\Omega_Z \quad (1).$$

A CP zone and a CT zone inside a target gamut $\Omega_T$ share common boundaries. One or more outer boundaries of the CP zone are the same as one or more inner boundaries of the CT zone, and one or more outer boundaries of the CT zone are the same as one or more boundaries of the target gamut $\Omega_T$. As the CP zone and the CT share common boundaries, coordinates (i.e., vertices) of the CP zone inside the target gamut $\Omega_T$ and coordinates of the CT zone inside the target gamut $\Omega_T$ are the same.

In one embodiment, for a target gamut $\Omega_T$ the zoning unit 240 is configured to: (1) determine coordinates (i.e., vertices) of a CP/CT zone inside the target gamut $\Omega_T$ and (2) determine boundaries (e.g., inner and outer boundaries) of the CP/CT zone based on the coordinates (e.g., by connecting the coordinates with straight lines in a clockwise direction or a counterclockwise direction).

In one embodiment, for a target gamut $\Omega_T$ the zoning unit 240 is configured to define a corresponding ratio $$\frac{\Omega_P}{\Omega_Z},$$

wherein the ratio $$\frac{\Omega_P}{\Omega_Z}$$

represents a size of a CP zone inside the target gamut $\Omega_T$ relative to a size of a CT zone inside the target gamut $\Omega_T$. In one embodiment, the zoning unit 240 is configured to adjust a size of a CP/CT zone inside a target gamut $\Omega_T$ by adjusting coordinates of the CP/CT zone inside the target gamut $\Omega_T$. In one embodiment, the zoning unit 240 is configured to adjust coordinates of a CP/CT zone inside a target gamut $\Omega_T$ to arbitrary positions as long as the CP zone is a convex triangle.

In one embodiment, for a target gamut $\Omega_T$, the zoning unit 240 is configured to define a corresponding ratio $$\frac{\Omega_P}{\Omega_Z}$$

that achieves a reasonable or optimum compromise between image details protection and preservation of saturation and/or color contrast. For example, in one embodiment, the zoning unit 240 is configured to: (1) receive a set of geometric parameters estimated for achieving a reasonable or optimum compromise between image details protection and preservation of saturation and/or color contrast, and (2) based on the set of geometric parameters, define the corresponding ratio $$\frac{\Omega_P}{\Omega_Z}$$

and divide the target gamut $\Omega_T$ into an inner CP zone and an outer CT zone. In one embodiment, the set of geometric parameters comprises one or more experimentally determined optimized ratios $$\frac{\Omega_P}{\Omega_Z}$$

recommended for CGM between different source gamuts $\Omega_S$ and target gamuts $\Omega_T$.

In one embodiment, for a target gamut $\Omega_T$, the zoning unit 240 is configured to define a corresponding ratio $$\frac{\Omega_P}{\Omega_Z}$$

that achieves a user-desired compromise between image details protection and preservation of saturation and/or color contrast. For example, if a user desires to preserve more saturation at the expense of protecting fewer image details, the zoning unit 240 is configured to define a ratio $$\frac{\Omega_P}{\Omega_Z}$$

that yields a bigger CP zone inside the target gamut $\Omega_T$ and a smaller CT zone in the target gamut $\Omega_T$, thereby resulting in increased preservation of saturation and/or color contrast but reduced image details protection. As another example, if a user desires to protect more image details at the expense of preserving less saturation, the zoning unit 240 is configured to define a ratio $$\frac{\Omega_P}{\Omega_Z}$$

that yields a smaller CP zone inside the target gamut $\Omega_T$ and a bigger CT zone in the target gamut $\Omega_T$, thereby resulting in increased image details protection but reduced preservation of saturation and/or color contrast.

For expository purposes, the term "saturation limit triangle" as used in this specification generally refers to a triangle representing a maximum saturation that colors in a source gamut $\Omega_S$ can achieve.

In some broadcasting systems, it is not necessary that colors of HDR/WCG content reach boundaries of a source gamut $\Omega_S$. For expository purposes, the term "color statistics" as used in this specification generally refers information indicative of percentage of a source gamut $\Omega_S$ occupied by colors of HDR/WCG content.

In one embodiment, for a source gamut $\Omega_S$, the zoning unit 240 is configured to define a corresponding saturation limit triangle (SLT) based on color statistics. In some embodiments, the SLT is the same as the source gamut $\Omega_S$ (i.e., the most saturated colors of HDR/WCG content received as input are located at the boundaries of the source gamut $\Omega_S$). For example, the zoning unit 240 is configured to define the SLT as equal to the source gamut $\Omega_S$. In some embodiments, the SLT is different from the source gamut $\Omega_S$. For example, to preserve more saturation, the zoning unit 240 is configured to define the SLT as a minimum triangle that covers all colors in the source gamut $\Omega_S$.

In one embodiment, the zoning unit 240 is configured to define a static SLT. In one embodiment, the zoning unit 240 is configured to define a SLT that is dynamically updated based on requirements of applications.

In one embodiment, the zoning unit 240 is configured to define a ratio $$\frac{\Omega_P}{\Omega_Z}$$

and/or a SLT either offline or online. If defined offline, the system 200 maintains a set of geometric parameters defining a CP zone and a CT zone in a small sized LUT. If defined online, the zoning unit 240 is configured to load a set of geometric parameters defining a CP zone and a CT zone from a LUT. In some cases, if the CP zone and the CT zone are defined online, content-adaptive geometric parameters for constructing the CP zone and the CT zone are necessary. In one embodiment, the zoning unit 240 is configured to generate content-adaptive geometric parameters for input content by either analyzing the input content or directly obtaining the parameters from dynamic metadata of the input content (e.g., from SMPTE ST.2094-40 metadata delivered in a HDR distribution eco-system). The system 200 adopts the content-adaptive CP and CT zone to maintain continuity of colors and preserve saturation, resulting in artifact-free output. In some embodiments, the zoning unit 240 is configured to generate content-adaptive geometric parameters for input content based on at least one of color gamut volume of a display device 60 the input content is presented on, the input content, or metadata corresponding to the input content.

In one embodiment, for an arbitrary color in a source gamut $\Omega_S$ that is inside a CP zone inside a target gamut $\Omega_T$, the system 200 maintains a corresponding position of the color (i.e., the position is unchanged). Specifically, a target position of the color in the target gamut $\Omega_T$ is the same as a source position of the color in the source gamut $\Omega_S$; the system 200 does not move the color. In some embodiments, the system 200 does not move colors in the source gamut $\Omega_S$ that are inside the CP zone (i.e., does not move source colors inside the inner zone of the target gamut $\Omega_T$).

Let $c_i$ generally denote an arbitrary color in a source gamut $\Omega_S$ that is outside of a CP zone inside a target gamut $\Omega_T$, wherein the color $c_i$ has a corresponding position in the CIE 1931 color space with coordinates $(x_i, y_i)$. Let $c_t$ generally denote a color $c_i$ that has been mapped (i.e., converted) from a source gamut $\Omega_S$ to a target gamut $\Omega_T$ and clipped to a boundary of the target gamut $\Omega_T$ (i.e., a clipped-to-boundary color/position), wherein $c_t$ has a corresponding position in the CIE 1931 color space with coordinates $(x_t, y_t)$. Let $c_z$ generally denote a color $c_i$ that has been mapped (i.e., converted) from a source gamut $\Omega_S$ to a CP zone (with color gamut $\Omega_P$) inside a target gamut $\Omega_T$ and clipped to a boundary of the CP zone (i.e., a clipped-to-boundary color), wherein $\Omega_S$ has a corresponding position in the CIE 1931 color space with coordinates $(x_z, y_z)$.

In one embodiment, for an arbitrary color $c_i$ in a source gamut $\Omega_S$ that is outside of a CP zone inside a target gamut $\Omega_T$, the system 200 is configured to move the color $c_i$ from a corresponding source position in the source gamut $\Omega_S$ to an appropriate target position in a CT zone inside a target gamut $\Omega_T$. As described in detail later herein, for an arbitrary color $c_i$ in a source gamut $\Omega_S$ that is outside of a CP zone inside a target gamut $\Omega_T$, the system 200 is configured to: (1) determine a representation of the color $c_i$ in the CIE 1931 color space by determining corresponding coordinates $(x_i, y_i)$ in the CIE 1931 color space, (2) determine a color moving path (CMP) of the color $c_i$ in the CIE 1931 color space, (3) move the color $c_i$ from a corresponding source position in the source gamut $\Omega_S$ to an appropriate target position in a CT zone inside the target gamut $\Omega_T$ based on the CMP, and (4) convert coordinates in the CIE 1931 color space that correspond to the appropriate target position in the CT zone to a corresponding color (e.g., a RGB color) in the target gamut $\Omega_T$. In some embodiments, the system 200 maps only colors in the source gamut $\Omega_S$ that are outside of the CP zone to the CT zone (i.e., maps only source colors that are outside of the inner zone of the target gamut $\Omega_T$ to the outer zone of the target gamut $\Omega_T$).

Depending on a size of a CT zone inside a target gamut $\Omega_T$, the system 200 partially preserves (i.e., saves) color variations and transitions in input content after CGM, thereby maintaining, in resulting output content, color continuity in colors mapped to the target gamut $\Omega_T$ and avoiding visible artifacts (which typically results from gamut clipping).

In one embodiment, the system 200 comprises a coordinates determination unit 210 configured to: (1) receive an arbitrary color $c_i$ in a source gamut $\Omega_S$ that is outside of a CP zone inside a target gamut $\Omega_T$, and (2) determine a representation of the color $c_i$ in the CIE 1931 color space by determining corresponding coordinates $(x_i, y_i)$ in the CIE 1931 color space.

In one embodiment, the system 200 is configured to control hue of colors mapped to a target gamut $\Omega_T$ by adaptively determining CMPs of the colors without utilizing any reference data. Therefore, unlike CAM-based CGM techniques that rely on reference data, the system 200 decreases computational complexity and hardware implementation costs associated with CGM.

In one embodiment, the system 200 comprises a CMP determination unit 220 configured to: (1) receive, as input, coordinates $(x_i, y_i)$ in the CIE 1931 color space that correspond to an arbitrary color $c_i$ in a source gamut $\Omega_S$ that is outside of a CP zone inside a target gamut $\Omega_T$ (e.g., from the coordinates determination unit 210), (2) receive, as input, a ratio $$\frac{\Omega_P}{\Omega_Z}$$

corresponding to the target gamut $\Omega_T$ (e.g., from the zoning unit 240), (3) receive, as input, a SLT corresponding to the source gamut $\Omega_S$ (e.g., from the zoning unit 240), and (4) adaptively determine a CMP of the color $c_i$ in the CIE 1931 color space based on each input received.

Unlike CAM-based CGM techniques, the CMP determination unit 220 does not utilize any reference data. Unlike conventional CSC-model based CGM techniques that map all OOGCs directly to boundaries of a target gamut $\Omega_T$, the CMP determination unit 220 is configured to adaptively determine, for each arbitrary color $c_i$, a corresponding CMP of the color $c_i$.

In one embodiment, a CMP of an arbitrary color $c_i$ in the CIE 1931 color space is a directional vector pointing from the color $c_i$ to corresponding clipped-to-boundary colors (e.g., $c_t$ and $c_z$). In one embodiment, a CMP of an arbitrary color $c_i$ in the CIE 1931 color space is a directional vector defined as $\overrightarrow{c_i,c_t,c_z}$. In one embodiment, $c_i$, $c_t$, and $c_z$ are not necessarily collinear. If coordinates of a source gamut $\Omega_S$, a target gamut $\Omega_T$, and a CP zone (with color gamut $\Omega_P$) inside the target gamut $\Omega_T$ are collinear, $c_i$, $c_t$, and $c_z$ are collinear, and a CMP of an arbitrary color $c_i$ in the CIE 1931 color space is simplified to a directional vector defined as $\overrightarrow{c_i,c_z}$.

In one embodiment, to adaptively determine a CMP of an arbitrary color $c_i$ in a source gamut $\Omega_S$ with corresponding coordinates $(x_i, y_i)$ in the CIE 1931 color space, the CMP determination unit 220 is configured to: (1) determine a first corresponding clipped-to-boundary color $c_t$ with corresponding coordinates $(x_t, y_t)$ in the CIE 1931 color space, and (2) determine a second corresponding clipped-to-boundary color $c_z$ with corresponding coordinates $(x_z, y_z)$ in the CIE 1931 color space.

Let $M_{ST}$ generally denote a conversion (i.e., CSC) matrix from a source gamut $\Omega_S$ to a target gamut $\Omega_T$ in the CIE 1931 color space. Let $M_{SP}$ generally denote a conversion matrix from a source gamut $\Omega_S$ to a CP zone (with color gamut $\Omega_P$) inside a target gamut $\Omega_T$ in the CIE 1931 color space.

In one embodiment, for an arbitrary color $c_i$ in a source gamut $\Omega_S$ with corresponding coordinates $(x_i, y_i)$ in the CIE 1931 color space, the CMP determination unit 220 is configured to determine a corresponding clipped-to-boundary color $c_t$ with corresponding coordinates $(x_t, y_t)$ in the CIE 1931 by: (1) converting (i.e., mapping) the color $c_i$ from the source gamut $\Omega_S$ to a target gamut $\Omega_T$ based on a conversion matrix $M_{ST}$, and (2) clipping the converted color to a boundary of the target gamut $\Omega_T$, wherein the resulting clipped color is the clipped-to-boundary color $c_t$.

In one embodiment, for an arbitrary color $c_i$ in a source gamut $\Omega_S$ with corresponding coordinates $(x_i, y_i)$ in the CIE 1931 color space, the CMP determination unit 220 is configured to determine a corresponding clipped-to-boundary color $c_z$ with corresponding coordinates $(x_z, y_z)$ in the CIE 1931 by: (1) converting (i.e., mapping) the color $c_i$ from the source gamut $\Omega_S$ to a CP zone (with color gamut $\Omega_P$) inside a target gamut $\Omega_T$ based on a conversion matrix $M_{SP}$, and (2) clipping the converted color to a boundary of the CP zone, wherein the resulting clipped color is the clipped-to-boundary color $c_Z$.

In one embodiment, the CMP determination unit 220 is configured to determine conversion matrices $M_{ST}$ and $M_{SP}$ based on coordinates of a source gamut $\Omega_S$, a target gamut $\Omega_T$, and a CP zone (with color gamut $\Omega_P$) inside the target gamut $\Omega_T$. In one embodiment, if coordinates of a source gamut $\Omega_S$, a target gamut $\Omega_T$, and a CP zone (with color gamut $\Omega_P$) inside the target gamut $\Omega_T$ are collinear, the CMP determination unit 220 is configured to determine, for an arbitrary color $c_i$ in the source gamut $\Omega_S$, a corresponding clipped-to-boundary color $c_z$, directly from a conversion matrix $M_{SP}$ derived from coordinates of the source gamut $\Omega_S$ and the CP zone, such that the clipped-to-boundary color $c_z$ can be determined directly from the color $c_i$.

In one embodiment, if coordinates of a source gamut $\Omega_S$, a target gamut $\Omega_T$, and a CP zone (with color gamut $\Omega_P$) inside the target gamut $\Omega_T$ are not collinear, the CMP determination unit 220 is configured to determine, for an arbitrary color $c_i$ in the source gamut $\Omega_S$, a corresponding clipped-to-boundary color $c_z$ by: (1) determining another corresponding clipped-to-boundary color $c_t$ from the color $c_i$ based on a conversion matrix $M_{ST}$ derived from coordinates of the source gamut $\Omega_S$ and the target gamut $\Omega_T$, and (2) determining the clipped-to-boundary color $c_z$ from the another corresponding clipped-to-boundary color $c_t$ based on a conversion matrix $M_{TP}$ derived from coordinates of the target gamut $\Omega_T$ and the CP zone. In one embodiment, these two steps can be combined into one step using a conversion matrix $M_{SP}$, wherein $M_{SP}=M_{ST}\times M_{TP}$.

Therefore, for any arbitrary ratio $$\frac{\Omega_P}{\Omega_Z},$$

the CMP determination unit 220 is configured to: (1) determine $c_t$ from $c_i$ based on a conversion matrix $M_{ST}$, and (2) determine $c_z$ from $c_i$ based on a conversion matrix $M_{SP}$.

Let $c_o$ generally denote a target position in a CT zone (with color gamut $\Omega_z$) inside a target gamut $\Omega_T$, wherein the target position $c_o$ is in between boundaries of the target gamut $\Omega_T$ and a CP zone (with color gamut $\Omega_P$) inside the target gamut $\Omega_T$.

In one embodiment, the system 200 comprises a color movement determination unit 230 configured to: (1) receive a CMP of an arbitrary color $c_i$ in a source gamut $\Omega_S$ that is outside of a CP zone inside a target gamut $\Omega_T$ (e.g., from the CMP determination unit 220), and (2) move the color $c_i$ from a corresponding source position in the source gamut $\Omega_S$ to an appropriate target position $c_o$ in a CT zone inside the target gamut $\Omega_T$ based on the CMP. In one embodiment, the color movement determination unit 230 is configured to determine the target position $c_o$ by maintaining a relative position of the color $c_i$ between boundaries of the source gamut $\Omega_S$ and the CP zone unchanged after mapping the color $c_i$ to the target position $c_o$ between boundaries of the target gamut $\Omega_T$ and the CP zone. For example, in one embodiment, the color movement determination unit 230 is configured to determine a distance between a pair of boundaries of the source gamut $\Omega_S$ and the target gamut $\Omega_T$ with a reference $c_f$, wherein $c_f$ represents an intersection of the CMP of the color $c_i$ and a boundary of a SLT corresponding to the source gamut $\Omega_S$ (i.e., $c_f$ is a reference position on the boundary of the SLT). A relative position of the color $c_i$ before the color $c_i$ is mapped is defined as a ratio of the color $c_i$ between the reference position $c_f$ and a clipped-to-boundary position $c_z$ on a boundary of the CP zone. A relative position of the color $c_i$ after the color $c_i$ is mapped is defined as a ratio of the target position $c_o$ between a clipped-to-boundary position $c_t$ on a boundary of the CT zone and the clipped-to-boundary position $c_z$.

In some embodiments, the system 200 is configured to: (1) determine a relative position of the color $c_i$ before the color $c_i$ is mapped, (2) determine a relative position of the color $c_i$ after the color $c_i$ is mapped, and (3) keep the relative positions of the color $c_i$ before and after the mapping unchanged (i.e., the ratio of the color $c_i$ between the reference position $c_f$ and the clipped-to-boundary position $c_z$ is the same as the ratio of the target position $c_o$ between the clipped-to-boundary position $c_t$ and the clipped-to-boundary position $c_z$).

In one embodiment, for an arbitrary color $c_i$ in a source gamut $\Omega_S$ that is outside of a CP zone inside a target gamut $\Omega_T$, the color movement determination unit 230 is configured to determine a relative position of the color $c_i$ as a ratio $\alpha(c_i)$ represented in accordance with equation (2) provided below:

$$\alpha(c_i) = \frac{|\overline{c_i c_z}|}{|\overline{c_f, c_t, c_z}|}. \tag{2}$$

In one embodiment, for an arbitrary color $c_i$ in a source gamut $\Omega_S$ that is outside of a CP zone inside a target gamut $\Omega_T$, the color movement determination unit 230 is configured to determine an appropriate target position $c_o$ inside the target gamut $\Omega_T$ that keeps the relative position of the color $c_i$ unchanged when $c_i$ is mapped between $c_t$ and $c_z$, such that the target position $c_o$ satisfies a condition represented by equation (3) provided below:

$$\alpha(c_i) = \frac{|\overline{c_o c_z}|}{|c_t c_z|}. \tag{3}$$

In one embodiment, the system 200 comprises a conversion unit 250 configured to: (1) receive a target position $c_o$ in a CT zone inside a target gamut $\Omega_T$ (e.g., from the color movement determination unit 230), and (2) convert coordinates in the CIE 1931 color space that correspond to the target position $c_o$ to a corresponding color (e.g., a RGB color) in the target gamut $\Omega_T$, wherein the corresponding color is included in output content the system 200 provides to a display device 60 for presentation.

The system 200 is capable of mapping OOGCs to artifact-free target colors and decreasing hue-shifting in the target colors.

If system resources are limited and hardware implementation costs must be low, in some embodiments, the system 200 enforces the following constraints: (1) coordinates of the CP zone and the CT zone are collinear with coordinates of the source gamut and the target gamut, such that all CMPs are straight lines, and 2) the SLT is equal to the source gamut, thus saving the content-analysis in in-linear processing.

Figure 3:
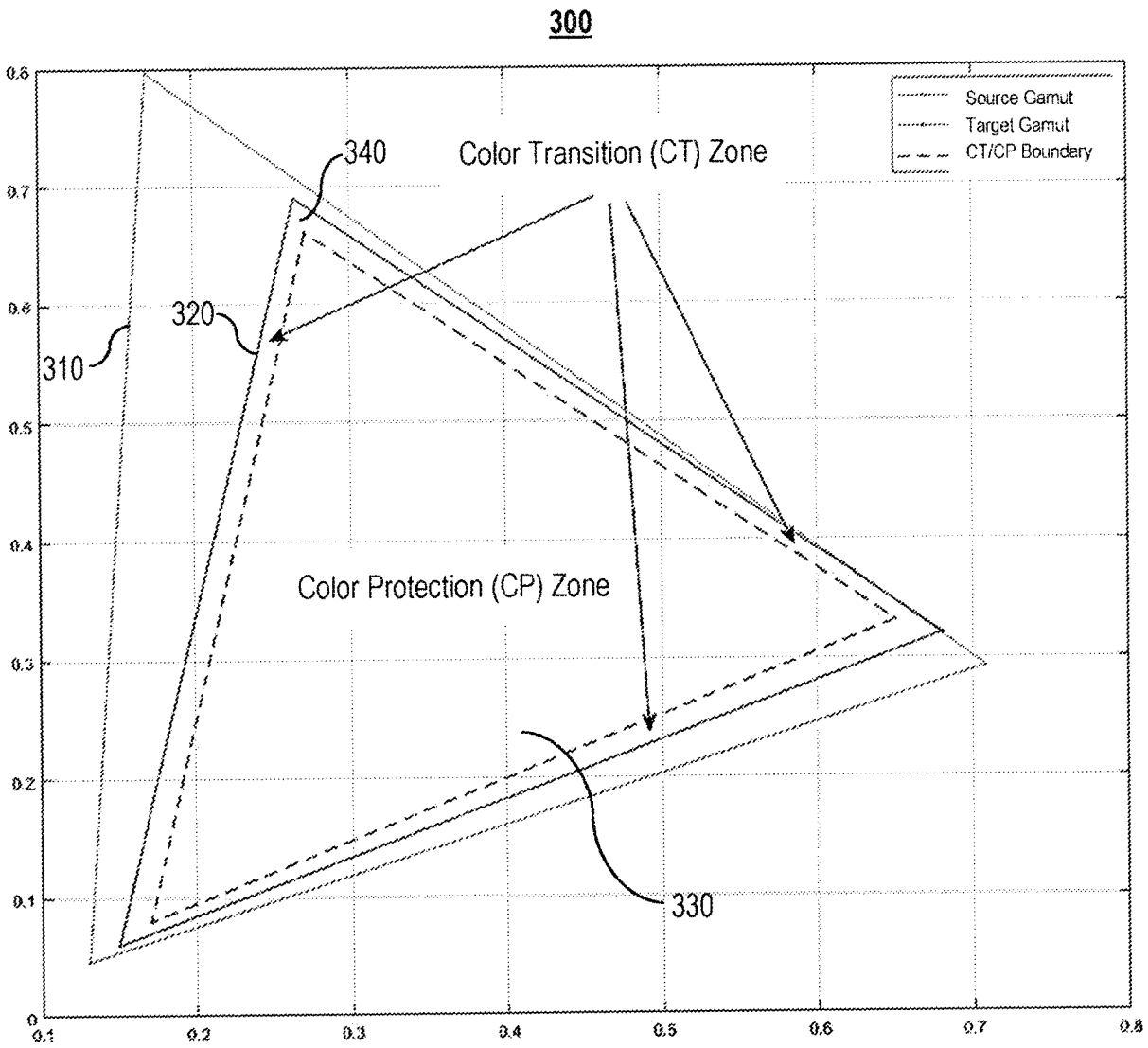
FIG. 3 is a graph illustrating a source color gamut in the CIE 1931 color space, a target color gamut in the CIE 1931 color space, a CP zone inside the target color gamut, and a CT zone inside the target color gamut, in one or more embodiments.

FIG. 3 is a graph 300 illustrating a source gamut in the CIE 1931 color space, a target gamut in the CIE 1931 color space, a CP zone inside the target gamut, and a CT zone inside the target gamut, in one or more embodiments. A horizontal axis of the graph 300 represents x-coordinates in the CIE 1931 color space. A vertical axis of the graph 300 represents y-coordinates in the CIE 1931 color space. The graph 300 comprises: (1) a first triangle 310 representing a SLT corresponding to a source gamut, (2) a second triangle 320 covering a target gamut (e.g., of a display device 60) that is smaller than the source gamut, (3) an inner zone 330 of the target gamut that represents a CP zone inside the target gamut, and (4) an outer zone 340 of the target gamut that represents a CT zone inside the target gamut.

Figure 4:
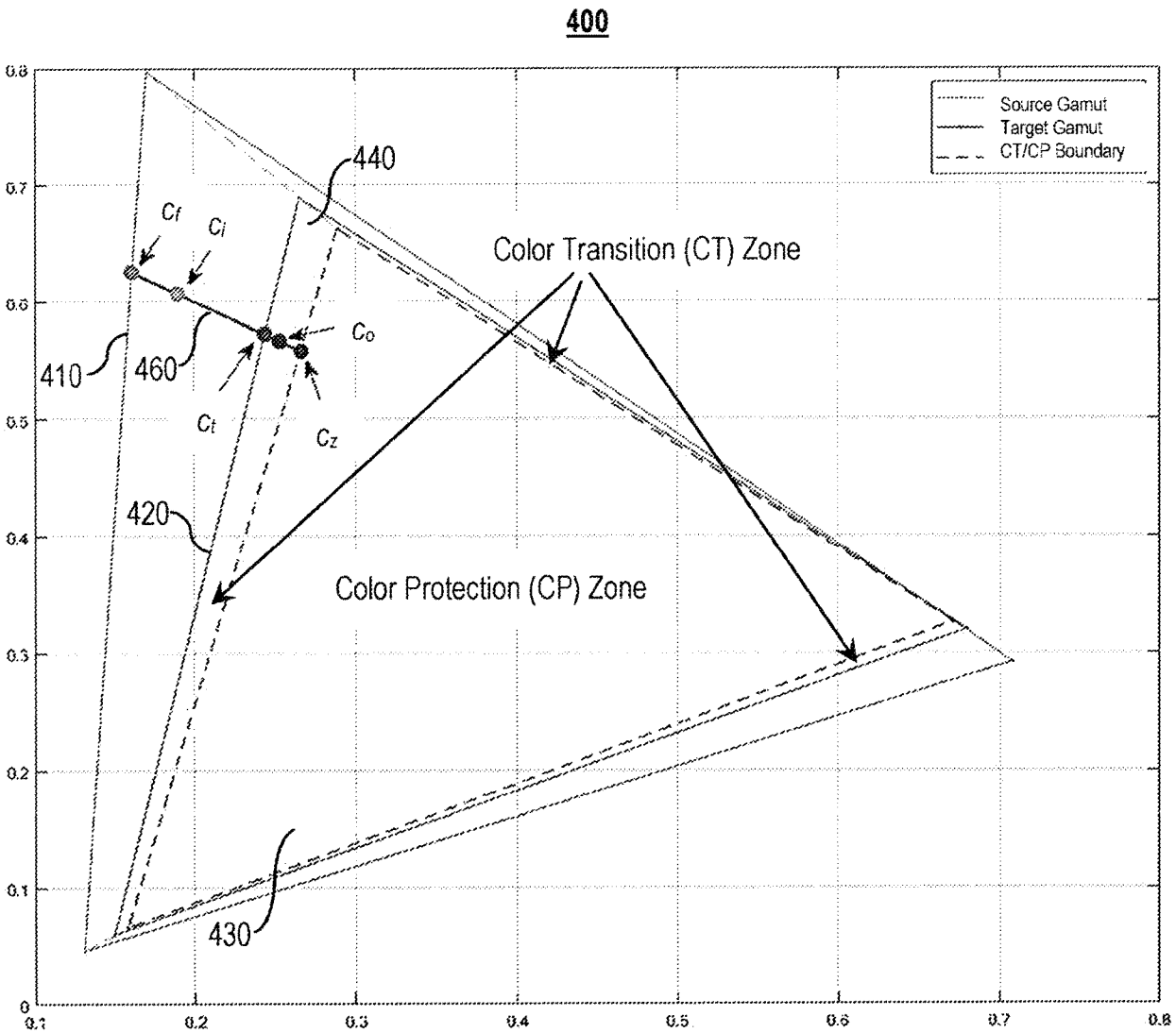
FIG. 4 is a graph illustrating a color moving path of an arbitrary color in a source color gamut in the CIE 1931 color space, in one or more embodiments.

FIG. 4 is a graph 400 illustrating a color moving path of an arbitrary color $c_i$ in a source gamut in the CIE 1931 color space, in one or more embodiments. A horizontal axis of the graph 400 represents x-coordinates in the CIE 1931 color space. A vertical axis of the graph 400 represents y-coordinates in the CIE 1931 color space. The graph 400 comprises: (1) a first triangle 410 representing a SLT corresponding to a source gamut, (2) a second triangle 420 covering a target gamut (e.g., of a display device 60) that is smaller than the source gamut, (3) an inner zone 430 of the target gamut that represents a CP zone inside the target gamut, and (4) an outer zone 440 of the target gamut that represents a CT zone inside the target gamut. The graph 400 further comprises a straight line 460 representing a CMP of an arbitrary color $c_i$ in the source gamut, wherein the straight line 460 includes a corresponding clipped-to-boundary color $c_t$ on a boundary of the target gamut, another corresponding clipped-to-boundary color $c_z$ on a boundary of the CP zone, a reference $c_f$ representing an intersection of the CMP 460 and a boundary of the SLT, and a corresponding target position $c_o$ in the CT zone.

Figure 5:
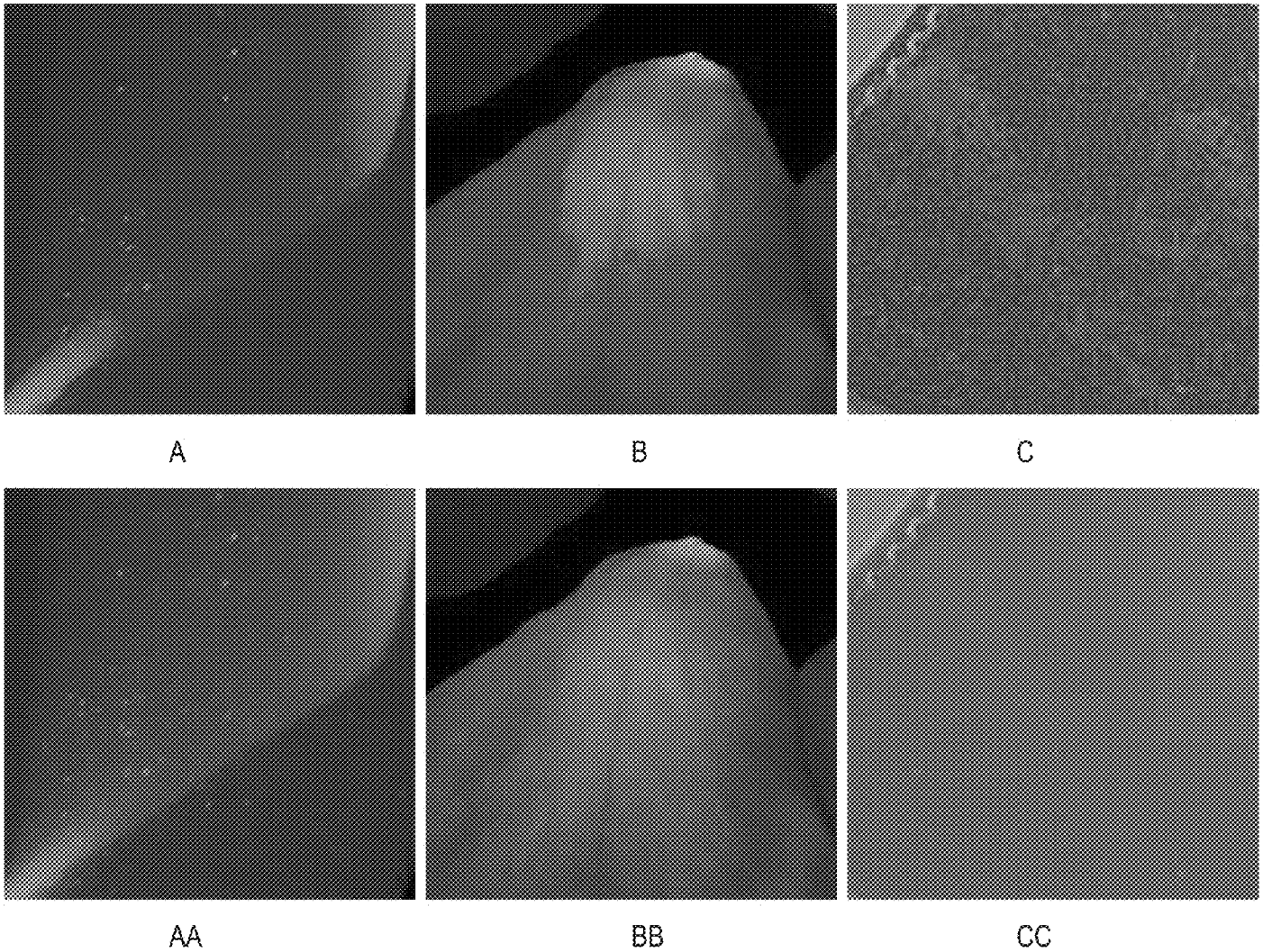
FIG. 5 illustrates a set of results comparing performance of a conventional color space conversion (CSC)-model based CGM technique against the CGM implemented by the system in FIG. 2, in one or more embodiments.

FIG. 5 illustrates a set of results comparing performance of a conventional CSC-model based CGM technique against the CGM implemented by the system 200, in one or more embodiments. The set of results comprises a first subset of images A, B, and C encompassing output generated via the conventional CSC-model based CGM technique for input content, and a second subset of images AA, BB, and CC encompassing output generated via the system 200 for the same input content. As shown in images A-C of FIG. 5, gamut clipping leads to visible banding and spot artifacts and also over-saturated colors. By comparison, the system 200 produces smooth and natural colors, and does not lead to any visible artifacts, as shown in images AA-CC of FIG. 5.

Figure 6:
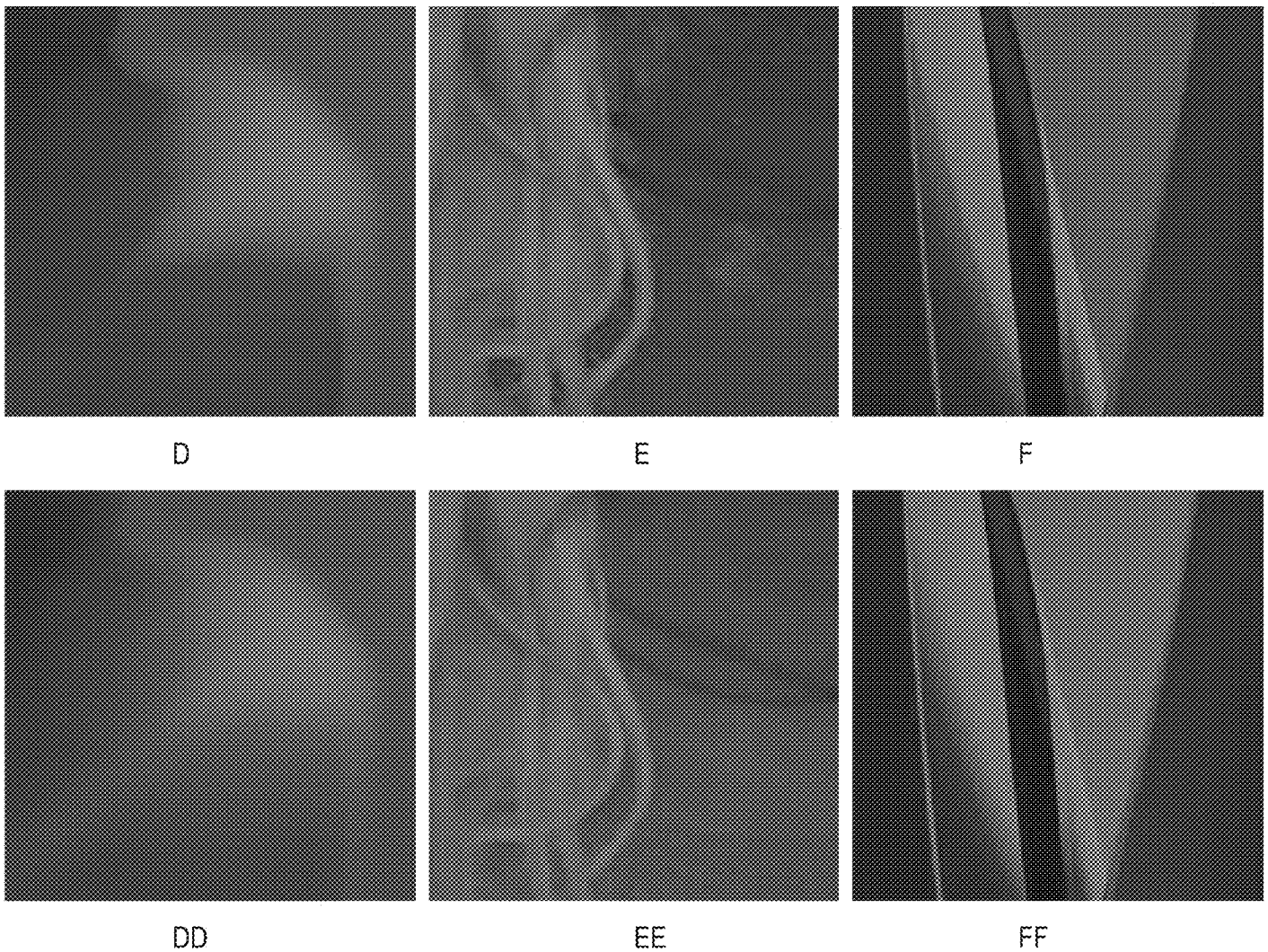
FIG. 6 illustrates another set of results comparing performance of a conventional CSC-model based CGM technique against the CGM implemented by the system in FIG. 2, in one or more embodiments.

FIG. 6 illustrates another set of results comparing performance of a conventional CSC-model based CGM technique against the CGM implemented by the system 200, in one or more embodiments. The set of results comprises a first subset of images D, E, and F encompassing output generated via the conventional CSC-model based CGM technique for input content, and a second subset of images DD, EE, and FF encompassing output generated via the system 200 for the same input content. As shown in images D-F of FIG. 6, gamut clipping leads to visible banding and spot artifacts and also over-saturated colors. By comparison, the system 200 produces smooth and natural colors, and does not lead to any visible artifacts, as shown in images DD-FF of FIG. 6.

Figure 7:
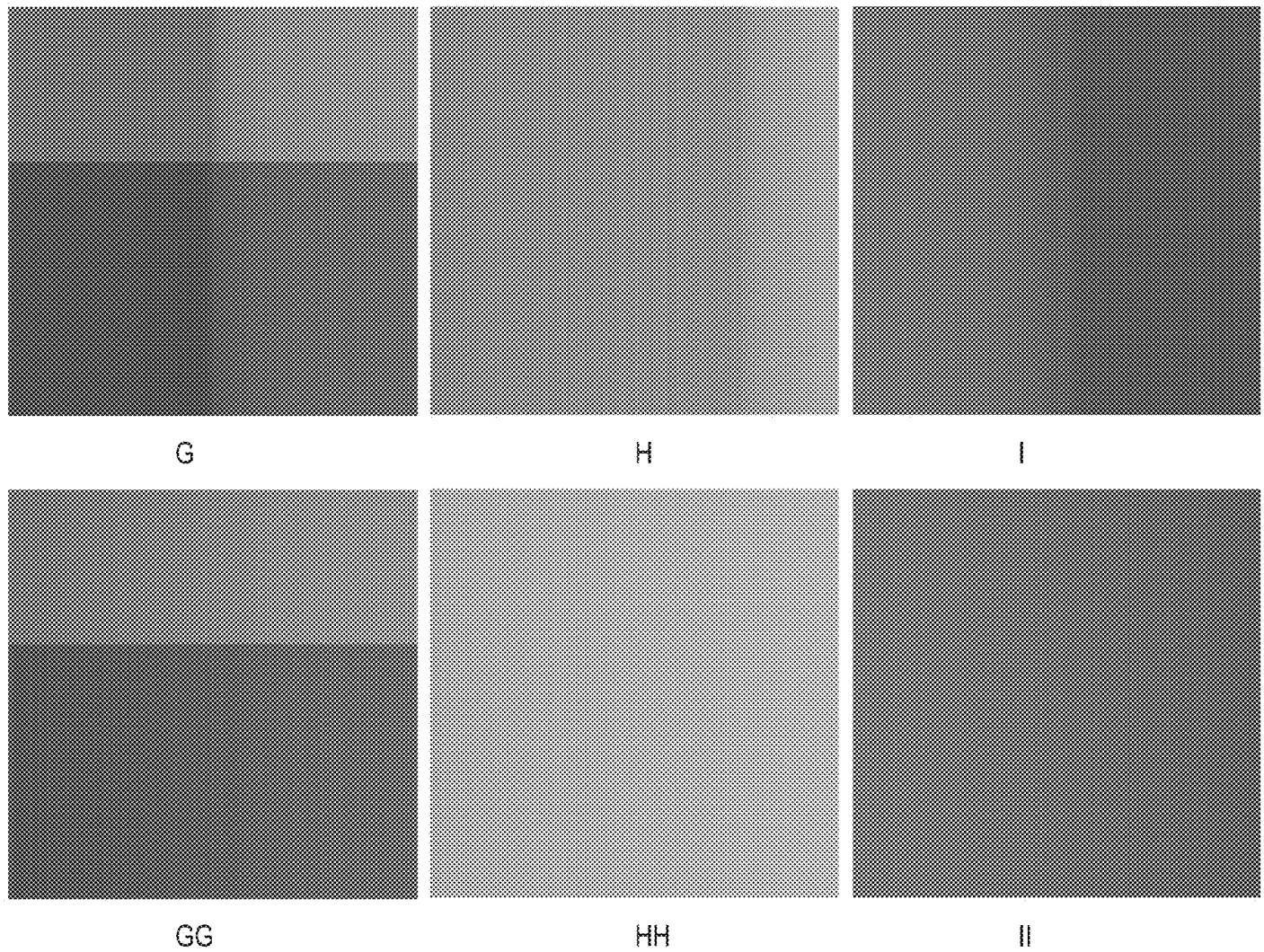
FIG. 7 illustrates yet another set of results comparing performance of a conventional CSC-model based CGM technique against the CGM implemented by the system in FIG. 2, in one or more embodiments.

FIG. 7 illustrates yet another set of results comparing performance of a conventional CSC-model based CGM technique against the CGM implemented by the system 200, in one or more embodiments. The set of results comprises a first subset of images G, H, and I encompassing output generated via the conventional CSC-model based CGM technique for input content, and a second subset of images GG, HH, and II encompassing output generated via the system 200 for the same input content. As shown in images G-I of FIG. 7, gamut clipping loses all continuity in OOGCs, leading to high visual impacts in regions of smooth and bright color transitions, and also leading to over-saturated colors. By comparison, the system 200 preserves continuity in OOGCs to produce visually preleasing colors, as shown in images GG-II of FIG. 7.

Figure 8:
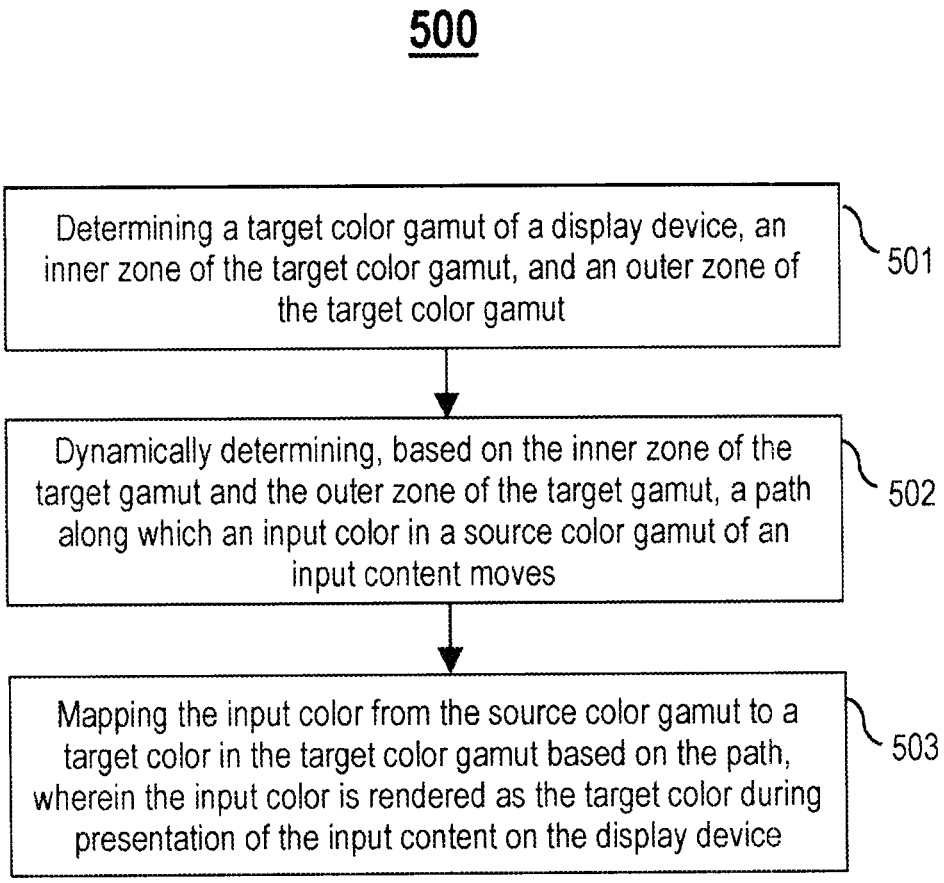
FIG. 8 is a flowchart of an example process for implementing color gamut mapping of HDR/WCG content for presentation on a display device, in one or more embodiments.

FIG. 8 is a flowchart of an example process 500 for implementing color gamut mapping of HDR/WCG content for presentation on a display device, in one or more embodiments. Process block 501 includes determining a target color gamut of a display device (e.g., a target gamut $\Omega_T$ of a display device 60), an inner zone of the target color gamut (e.g., a CP zone with color gamut $\Omega_P$ inside the target gamut $\Omega_T$), and an outer zone of the target color gamut (e.g., a CT zone with color gamut $\Omega_Z$ inside the target gamut $\Omega_T$). Process block 502 includes dynamically determining, based on the inner zone of the target color gamut and the outer zone of the target color gamut, a path along which an input color in a source color gamut of an input content moves (e.g., a CMP of an arbitrary color $c_i$ in a source gamut $\Omega_S$ of HDR/WCG content). Process block 503 includes mapping the input color from the source color gamut to a target color in the target color gamut based on the path, wherein the input color is rendered as the target color during presentation of the input content on the display device.

In one embodiment, process blocks 501-503 may be performed by one or more components of the color gamut mapping system 200.

Figure 9:
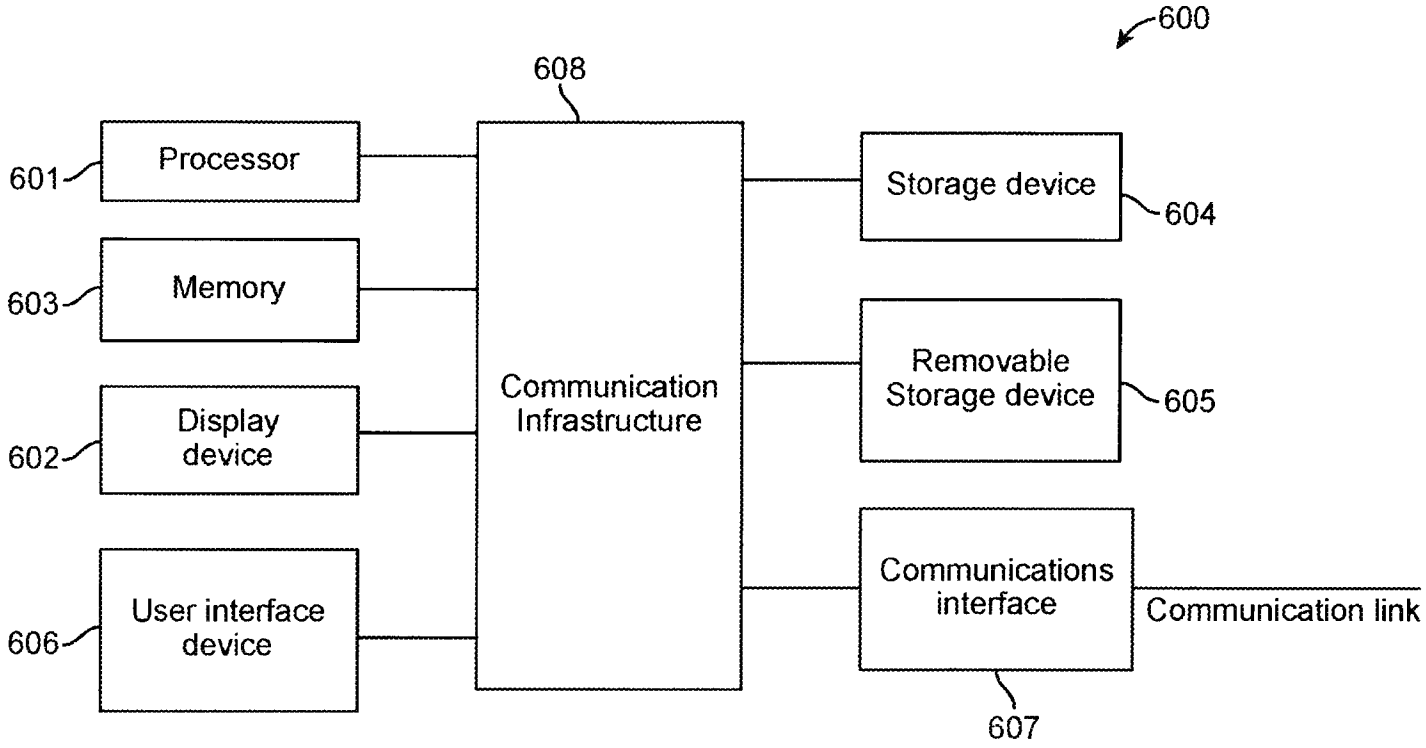
FIG. 9 is a high-level block diagram showing an information processing system comprising a computer system useful for implementing the disclosed embodiments.

FIG. 9 is a high-level block diagram showing an information processing system comprising a computer system 600 useful for implementing the disclosed embodiments. The systems 190 and 200 may be incorporated in the computer system 600. The computer system 600 includes one or more processors 601, and can further include an electronic display device 602 (for displaying video, graphics, text, and other data), a main memory 603 (e.g., random access memory (RAM)), storage device 604 (e.g., hard disk drive), removable storage device 605 (e.g., removable storage drive, removable memory module, a magnetic tape drive, optical disk drive, computer readable medium having stored therein computer software and/or data), viewer interface device 606 (e.g., keyboard, touch screen, keypad, pointing device), and a communication interface 607 (e.g., modem, a network interface (such as an Ethernet card), a communications port, or a PCMCIA slot and card). The communication interface 607 allows software and data to be transferred between the computer system and external devices. The system 600 further includes a communications infrastructure 608 (e.g., a communications bus, cross-over bar, or network) to which the aforementioned devices/modules 601 through 607 are connected.

Information transferred via communications interface 607 may be in the form of signals such as electronic, electromagnetic, optical, or other signals capable of being received by communications interface 607, via a communication link that carries signals and may be implemented using wire or cable, fiber optics, a phone line, a cellular phone link, an radio frequency (RF) link, and/or other communication channels. Computer program instructions representing the block diagram and/or flowcharts herein may be loaded onto a computer, programmable data processing apparatus, or processing devices to cause a series of operations performed thereon to generate a computer implemented process. In one embodiment, processing instructions for process 500 (FIG. 8) may be stored as program instructions on the memory 603, storage device 604, and/or the removable storage device 605 for execution by the processor 601.

Embodiments have been described with reference to flowchart illustrations and/or block diagrams of methods, apparatus (systems) and computer program products. Each block of such illustrations/diagrams, or combinations thereof, can be implemented by computer program instructions. The computer program instructions when provided to a processor produce a machine, such that the instructions, which execute via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium", and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of one or more embodiments are described above with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the disclosed technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the disclosed technology.

Though the embodiments have been described with reference to certain versions thereof; however, other versions are possible. Therefore, the spirit and scope of the appended claims should not be limited to the description of the preferred versions contained herein.

What is claimed is:

1. A method comprising:

determining a target color gamut of a display device, an inner zone of the target color gamut, and an outer zone of the target color gamut based on an input content for presentation on the display device;

adjusting amount of image details to protect and amount of saturation and color contrast to preserve during the presentation of the input content on the display device by adjusting a size of the inner zone relative to a size of the outer zone based on at least one of the input content or metadata corresponding to the input content, wherein the size of the inner zone is increased and the size of the outer zone is decreased to increase the amount of saturation and color contrast to preserve, and the size of the inner zone is decreased and the size of the outer zone is increased to increase the amount of image details to preserve;

dynamically determining, based on the inner zone and the outer zone, a path along which an input color in a source color gamut of the input content moves, wherein the input color is outside the inner zone; and mapping the input color from the source color gamut to an output color in the outer zone based on the path, wherein the input color is rendered as the output color during the presentation of the input content on the display device.

2. The method of claim 1, wherein the input color is mapped from the source color gamut in a non-uniform color space to the output color in the outer zone in the non-uniform color space.

3. The method of claim 2, wherein the non-uniform color space is the CIE 1931 color space.

4. The method of claim 2, further comprising:

determining a saturation limit triangle (SLT) representing maximum saturation for input colors in the source color gamut based on one of the input content or the metadata corresponding to the input content, wherein the path is further based on the SLT.

5. The method of claim 1, further comprising:

determining the inner zone and the outer zone based on at least one of the target color gamut, the input content, or the metadata corresponding to the input content.

6. The method of claim 1, wherein:

a ratio of the size of the inner zone relative to the size of the outer zone is adjustable to increase either one of the amount of image details to protect or the amount of saturation and color contrast to preserve;

to increase the amount of saturation and color contrast to preserve, the ratio is adjusted such that the size of the inner zone is larger and the size of the outer zone is smaller; and to increase the amount of image details to protect, the ratio is adjusted such that the size of the inner zone is smaller and the size of the outer zone is larger.

7. The method of claim 4, wherein mapping the input color from the source color gamut to an output color in the outer zone based on the path comprises:

converting the input color from the source color gamut to a first converted color in the target color gamut and a second converted color in a color gamut of the inner zone based on a first color space conversion matrix and a second color space conversion matrix, respectively; and clipping the first converted color and the second converted color to a first position on a first boundary of the target color gamut and a second position on a second boundary of the inner zone to obtain a first clipped color and a second clipped color, respectively.

8. The method of claim 7, wherein the path includes coordinates of the input color in the non-uniform color space, coordinates of the first clipped color at the first position in the non-uniform color space, coordinates of the second clipped color at the second position in the non-uniform color space, coordinates of the output color in the non-uniform space, and coordinates of a third position in the non-uniform space, the third position represents an intersection of the path and a third boundary of the source color gamut, and the third position is included in the SLT.

9. The method of claim 8, wherein a first ratio of a first distance between the input color and the second position to a second distance between the third position and the second position is the same as a second ratio of a third distance between the output color and the second position to a fourth distance between the first position and the second position.

10. A system comprising:

at least one processor; and a non-transitory processor-readable memory device storing instructions that when executed by the at least one processor causes the at least one processor to perform operations including:

determining a target color gamut of a display device, an inner zone of the target color gamut, and an outer zone of the target color gamut based on an input content for presentation on the display device;

adjusting amount of image details to protect and amount of saturation and color contrast to preserve during the presentation of the input content on the display device by adjusting a size of the inner zone relative to a size of the outer zone based on at least one of the input content or metadata corresponding to the input content, wherein the size of the inner zone is increased and the size of the outer zone is decreased to increase the amount of saturation and color contrast to preserve, and the size of the inner zone is decreased and the size of the outer zone is increased to increase the amount of image details to preserve;

dynamically determining, based on the inner zone and the outer zone, a path along which an input color in a source color gamut of the input content moves, wherein the input color is outside the inner zone; and mapping the input color from the source color gamut to an output color in the outer zone based on the path, wherein the input color is rendered as the output color during presentation of the input content on the display device.

11. The system of claim 10, wherein the input color is mapped from the source color gamut in a non-uniform color space to the output color in the outer zone in the non-uniform color space.

12. The system of claim 11, wherein the non-uniform color space is the CIE 1931 color space.

13. The system of claim 12, wherein the operations further include:

determining a saturation limit triangle (SLT) representing maximum saturation for input colors in the source color gamut based on one of the input content or the metadata corresponding to the input content, wherein the path is further based on the SLT.

14. The system of claim 10, wherein the operations further include:

determining the inner zone and the outer zone based on at least one of the target color gamut, the input content, or the metadata corresponding to the input content.

15. The system of claim 10, wherein:

a ratio of the size of the inner zone relative to the size of the outer zone is adjustable to increase either one of the amount of image details to protect or the amount of saturation and color contrast to preserve;

to increase the amount of saturation and color contrast to preserve, the ratio is adjusted such that the size of the inner zone is larger and the size of the outer zone is smaller; and to increase the amount of image details to protect, the ratio is adjusted such that the size of the inner zone is smaller and the size of the outer zone is larger.

16. The system of claim 13, wherein mapping the input color from the source color gamut to an output color in the outer zone based on the path comprises:

converting the input color from the source color gamut to a first converted color in the target color gamut and a second converted color in a color gamut of the inner zone based on a first color space conversion matrix and a second color space conversion matrix, respectively; and clipping the first converted color and the second converted color to a first position on a first boundary of the target color gamut and a second position on a second boundary of the inner zone to obtain a first clipped color and a second clipped color, respectively.

17. The system of claim 16, wherein the path includes coordinates of the input color in the non-uniform color space, coordinates of the first clipped color at the first position in the non-uniform color space, coordinates of the second clipped color at the second position in the non-uniform color space, coordinates of the output color in the non-uniform space, and coordinates of a third position in the non-uniform space, the third position represents an intersection of the path and a third boundary of the source color gamut, and the third position is included in the SLT.

18. The system of claim 17, wherein a first ratio of a first distance between the input color and the second position to a second distance between the third position and the second position is the same as a second ratio of a third distance between the output color and the second position to a fourth distance between the first position and the second position.

19. A non-transitory processor-readable medium that includes a program that when executed by a processor performs a method comprising:

determining a target color gamut of a display device, an inner zone of the target color gamut, and an outer zone of the target color gamut based on an input content for presentation on the display device;

adjusting amount of image details to protect and amount of saturation and color contrast to preserve during the presentation of the input content on the display device by adjusting a size of the inner zone relative to a size of the outer zone based on at least one of the input content or metadata corresponding to the input content, wherein the size of the inner zone is increased and the size of the outer zone is decreased to increase the amount of saturation and color contrast to preserve, and the size of the inner zone is decreased and the size of the outer zone is increased to increase the amount of image details to preserve;

dynamically determining, based on the inner zone and the outer zone, a path along which an input color in a source color gamut of the input content moves, wherein the input color is outside the inner zone; and mapping the input color from the source color gamut to an output color in the outer zone based on the path, wherein the input color is rendered as the output color during the presentation of the input content on the display device.

20. The non-transitory processor-readable medium of claim 19, wherein the input color is mapped from the source color gamut in a non-uniform color space to the output color in the outer zone in the non-uniform color space.

* * * * *